US005798479A

United States Patent [19]

Bonamy

[11] Patent Number: 5,798,479

[45] Date of Patent: Aug. 25, 1998

[54] UNDERSIZED KINETIC-ENERGY PRACTICE PROJECTILE OF THE DART TYPE

[75] Inventor: Jean-Pierre Bonamy, Crosses, France

[73] Assignee: Etat Francais represente par le Deleque General pour l'Armement, Paris, France

[21] Appl. No.: 725,828

[22] Filed: Oct. 7, 1996

[30] Foreign Application Priority Data

Oct. 5, 1995 [FR] France ..... 95 11699

[51] Int. Cl.[6] ..... F42B 10/48; F42B 8/12

[52] U.S. Cl. ..... 102/529; 102/517; 244/3.1; 244/33

[58] Field of Search ..... 102/395, 498, 102/517, 521, 529, 502, 444; 244/3.23, 3.24, 3.3, 3.1

[56] References Cited

U.S. PATENT DOCUMENTS

| | | | |
|---|---|---|---|
| 4,140,061 | 2/1979 | Campoli . | |
| 4,242,960 | 1/1981 | Boeder et al. . | |
| 4,421,033 | 12/1983 | Dupont . | |
| 4,519,316 | 5/1985 | Bethmann et al. | 102/513 |
| 4,520,972 | 6/1985 | Diesinger et al. | 102/529 |
| 4,535,698 | 8/1985 | Yuen . | |
| 4,553,482 | 11/1985 | Weber et al. . | |
| 4,682,546 | 7/1987 | Chovich | 102/529 |
| 4,788,915 | 12/1988 | Sauvestre | 102/521 |
| 5,070,791 | 12/1991 | Dineen et al. . | |

FOREIGN PATENT DOCUMENTS

| | | | |
|---|---|---|---|
| 2412049 | 7/1979 | France . | |
| 2490803 | 3/1982 | France . | |
| 2496867 | 6/1982 | France . | |
| 3842728 | 1/1990 | Germany | 102/529 |
| 3927799 | 2/1991 | Germany | 102/529 |
| 40 28 410 | 3/1992 | Germany . | |

*Primary Examiner*—Harold J. Tudor
*Attorney, Agent, or Firm*—Oliff & Berridge, P.L.C.

[57] ABSTRACT

An undersized kinetic-energy practice projectile of the dart type includes a penetrator and a tail unit that can be dissociated from one another while the projectile is in flight. The penetrator and the tail unit can be separated after a predetermined flight duration, by relative rotation of the tail unit with respect to the penetrator in response to the aerodynamic forces being exerted on the tail unit. This can be achieved by an element that is integral with the penetrator and is screwed onto a threaded part of the tail unit.

9 Claims, 1 Drawing Sheet

UNDERSIZED KINETIC-ENERGY PRACTICE PROJECTILE OF THE DART TYPE

TECHNICAL FIELD

The technical field of the present invention is that of projectiles, such as for guns, and more particularly undersized kinetic-energy practice projectiles of the dart type.

BACKGROUND

Projectiles, possessing a very high initial speed, comprise a stabilizing tail unit with low aerodynamic drag which allows a very long range of approximately 80 to 100 kilometers.

During firing exercises, this range requires the availability of a safety area which is often incompatible with the dimensions of many firing ranges, such as Western and particularly European firing ranges.

To simulate the actual firing of such combat projectiles, it is advantageous to have available a practice projectile which has the same aerodynamic characteristics as those of the actual projectile, as well as an identical trajectory out to usual combat distances, which can reach 3000 meters. To remain within firing range safety standards, the maximum range of this projectile must be limited to approximately 10 kilometers.

Several implementations in this field have already been proposed.

Practice projectiles are known which are lighter than combat projectiles, possess a very high initial speed (sometimes greater than the nominal speed of the projectiles which they are simulating), and are equipped with a tail unit whose drag is much greater than that of the actual projectiles. The similarity between the trajectory of these practice projectiles and that of an actual projectile is therefore highly imperfect. Given the high drag of the tail unit, this type of practice projectile cannot, in practice, be used beyond 1500 meters due to high sensitivity to wind beyond that distance.

Also known are practice projectiles comprised of at least two parts, separated by breakage points, which can be dissociated from one another by delayed-action pyrotechnic disintegrators which are triggered at the time the projectile is fired. Projectiles of this type are described, for example, in French Patents 2,496,867 and 2,490,803. A major drawback of this type of projectile is its insufficient reliability, associated with excessive complexity of the pyrotechnic device.

Also known is French Patent 2,412,049, which describes a practice projectile that disintegrates automatically in flight by aerodynamic heating ablation of the connecting parts which join the components of the projectile body. This projectile exhibits a drawback due to the lack of reliability in terms of disintegration distances, which depend on climatic conditions at the time of firing.

SUMMARY OF THE INVENTION

A goal of the present invention is to eliminate the drawbacks discussed above with an undersized kinetic-energy practice projectile of the dart type which much more perfectly simulates an actual projectile, having the same mass, the same aerodynamic coefficient, and an effective trajectory that is substantially identical over approximately 3000 meters, corresponding to the effective combat distances generally encountered.

Another goal of the present invention is to remain within limitations imposed by the safety standards of firing ranges, by abruptly modifying the aerodynamic characteristics of the missile to interrupt its flight after a predetermined period.

Another goal of the invention is to propose a practice projectile which is very reliable and simple to implement, and costs little or no more to manufacture than an operational projectile.

An undersized kinetic-energy practice projectile of the dart type of the invention comprises a penetrator and a tail unit that can be dissociated from one another while the projectile is in flight. The penetrator and the tail unit comprise a mechanical arrangement for separating them, after a predetermined flight duration, by relative rotation of the tail unit with respect to the penetrator in response to aerodynamic forces being exerted on the tail unit.

Preferably the penetrator and tail unit are separable by way of an element that is integral with the penetrator and is screwed onto a threaded part of the tail unit. The element that is integral, and preferably coaxial, with the penetrator can include external threads with very fine pitch. Preferably the practice projectile comprises a cylinder placed along the rear extension of the threads to provide coaxial guidance of the tail unit before it separates from the penetrator. Preferably the length of the threads and the thread pitch are determined as a function of the predetermined flight duration of the projectile.

This practice projectile has the advantage of being very stable out to usual combat distances, substantially identically reproducing the trajectory of the combat munitions that it is simulating.

Another advantage consists in the operating simplicity of the mechanical arrangement for separating the tail unit and the penetrator, which ensure very good reliability for the projectile in remaining within the limits imposed by firing range safety standards.

In addition to these advantages, the invention also makes it possible to use most of the elements of the combat projectile to implement this practice projectile, thus reducing production costs.

Other characteristics and advantages of the invention will appear in or be evident from the detailed but non-limiting description below.

BRIEF DESCRIPTION OF THE DRAWING

The following description will be made with reference to FIG. 1, which depicts a schematic view, in longitudinal section, of the rear portions of a practice projectile according to the invention.

DETAILED DESCRIPTION OF EMBODIMENTS

Figure 1:
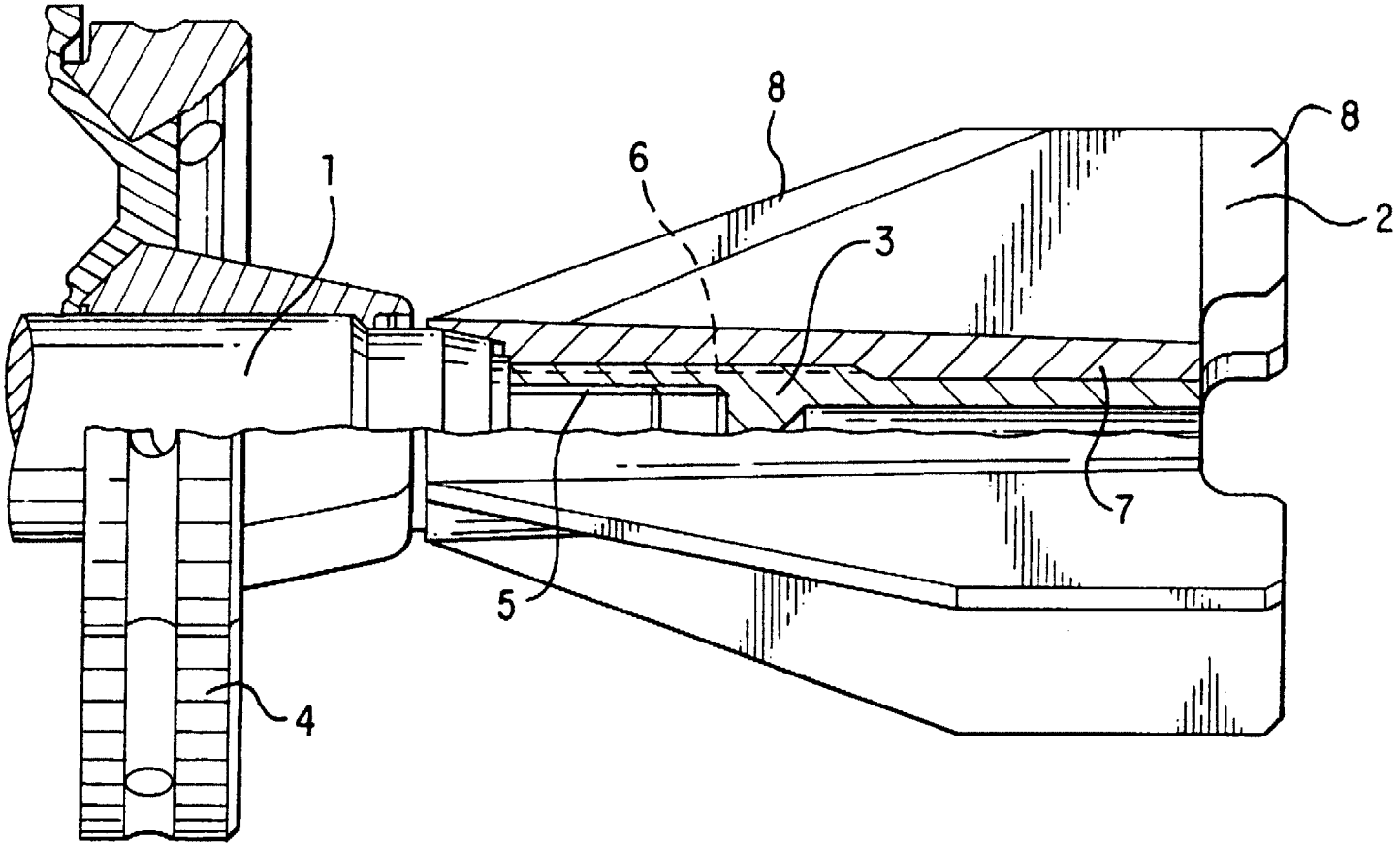

FIG. 1 shows an undersized kinetic-energy practice projectile of the dart type, comprising a penetrator 1, a tail unit 2 located at the rear of the projectile, a center part 3 which connects penetrator 1 and tail unit 2, and a separable sabot 4.

Sabot 4, which is eliminated after the projectile has left the mouth of the gun, is not essential to the present invention and therefore is not described in detail.

Penetrator 1 and center part 3 are connected, and preferably made integral and coaxial, by any known method; for example by way of threads 5 which cannot be disassembled during the ballistic lifetime of the projectile.

Center part 3 and tail unit 2 may be made coaxial by a fitted cylinder 7, and are preferably connected by a very fine-pitch threaded connection 6.

The length of threads 6 and that of fitted cylinder 7 are preferably substantially equivalent.

The length and the pitch of threads 6 may be determined as a function of the flight duration of the projectile, which is in preferred embodiments approximately two seconds after emerging from the gun.

The practice projectile of FIG. 1 operates as follows:

After the projectile is fired and emerges from the gun barrel, aerodynamic forces act on tail unit 2, creating an unscrewing torque, generated by the chambers 8 of the leading or trailing edge of the fins. This torque causes gradual unscrewing of tail unit 2 until it detaches from center part 3. The shape of the chamfers 8 can be selected to achieve a desired torque.

Until the tail unit has unscrewed completely, fitted cylinder 7 guides the tail unit until it separates definitively from center part 3. Separation of the tail unit and the penetrator destabilizes the projectile, which then very rapidly falls back to earth.

In order to remain within certain firing range safety standards, and for a 105-mm caliber projectile, for example, threaded part 6 has threads with an extremely fine pitch, on the order of 0.25 to 1 mm, over a length of approximately 50 mm.

When the tail unit is screwed onto center part 3, it is advisable to maintain a sufficiently low torque to ensure that separation of these two elements by relative rotation of the tail unit with respect to the penetrator does indeed occur after the predetermined flight duration.

What is claimed is:

1. A kinetic-energy practice projectile, comprising a penetrator and a tail unit separably connected to the penetrator, wherein a separable connection includes a center member extending from a tail end of the penetrator having an external threaded portion thereon, said tail unit includes a hollow tubular member having threads on an inner surface thereof which mates with said external threaded portion, wherein the separable connection between the penetrator and the tail unit separates after a predetermined flight duration by rotation of the tail unit with respect to the penetrator in response to aerodynamic forces exerted on a plurality of fins mounted on the tail unit.

2. The practice projectile of claim 1, wherein said central member is coaxial with said penetrator.

3. The practice projectile of claim 2, wherein the hollow tubular member of the tail unit provides coaxial guidance of the tail unit before it separates from the center member.

4. The practice projectile of claim 3, wherein the threads of the tail unit and the external threaded portion have a predetermined pitch for a predetermined flight duration of the projectile.

5. The practice projectile of claim 1, wherein at least one of said plurality of fins comprise at least one chamfer on at least one of a leading and trailing edge, said aerodynamic forces comprising a torque generated by air flow over said at least one chamfer.

6. A method for limiting a flight distance of a kinetic-energy practice projectile, comprising:

stabilizing said projectile in flight with a tail unit connected to a penetrator of said projectile, a center member extending from a tail end of the penetrator having an external threaded portion thereon, said tail unit includes a hollow tubular member having threads on an inner surface thereof which mates with said external threaded portion, and separating said tail unit from said penetrator after a predetermined flight duration by relative rotation of the tail unit with respect to the penetrator in response to aerodynamic forces exerted on a plurality of fins mounted on the tail unit.

7. The method of claim 6, further comprising providing coaxial guidance of the tail unit relative to the penetrator during said relative rotation until the tail unit separates from the penetrator.

8. The method of claim 6, wherein said aerodynamic forces comprise a torque generated by air flow over at least one chamfer on at least one of a leading and trailing edge of at least one fin of said tail unit.

9. An apparatus for limiting a flight distance of a kinetic-energy practice projectile, comprising:

means for stabilizing said projectile in flight with a tail unit connected to a penetrator of said projectile, and means for separating said tail unit from said penetrator after a predetermined flight duration by relative rotation of the tail unit with respect to the penetrator in response to aerodynamic forces exerted on a plurality of fins mounted on the tail unit, said means for separating including a center member extending from a tail end of the penetrator having an external threaded portion thereon, said tail unit includes a hollow tubular member having threads on an inner surface thereof which mates with said external threaded portion.

* * * * *